US007393116B1

(12) United States Patent
Holmes

(10) Patent No.: US 7,393,116 B1
(45) Date of Patent: Jul. 1, 2008

(54) PLANT AND ROOM ILLUMINATION APPARATUS

(76) Inventor: Steve Donald Holmes, 3976 Timberwood Dr., Memphis, TN (US) 38128

( * ) Notice: Subject to any disclaimer, the term of this patent is extended or adjusted under 35 U.S.C. 154(b) by 0 days.

(21) Appl. No.: 11/683,980

(22) Filed: Mar. 8, 2007

(51) Int. Cl.
*F21W 121/00* (2006.01)

(52) U.S. Cl. ..... 362/154; 362/122; 362/253

(58) Field of Classification Search ..... 362/154, 362/122, 123, 253, 145, 153, 153.1, 802, 362/805, 806
See application file for complete search history.

(56) References Cited

U.S. PATENT DOCUMENTS

| | | | | |
|---|---|---|---|---|
| 2,714,652 | A | 8/1955 | Meyer | |
| 2,797,310 | A | 6/1957 | Moore | |
| 3,015,720 | A | 1/1962 | Silverman | |
| 4,826,448 | A | 5/1989 | Maddock | |
| 4,996,636 | A | 2/1991 | Lovett | |
| 5,036,447 | A | 7/1991 | Taylor | |
| 5,055,987 | A * | 10/1991 | Ellson et al. | 362/277 |
| 5,297,013 | A | 3/1994 | Hall et al. | |
| 5,406,466 | A * | 4/1995 | Stokes | 362/153.1 |
| 5,741,061 | A | 4/1998 | Lehmann et al. | |
| 5,879,071 | A | 3/1999 | Sanford, Jr. | |
| 6,076,940 | A | 6/2000 | Sanford, Jr. | |
| 6,561,681 | B1 * | 5/2003 | Huang | 362/311 |
| 6,874,905 | B1 * | 4/2005 | Beadle | 362/153.1 |
| 2003/0235054 | A1 * | 12/2003 | Ruggles | 362/431 |
| 2005/0013137 | A1 * | 1/2005 | Burton, Jr. | 362/431 |
| 2005/0083681 | A1 * | 4/2005 | Yeh | 362/122 |
| 2005/0117338 | A1 * | 6/2005 | Kratz | 362/249 |

FOREIGN PATENT DOCUMENTS

| | | |
|---|---|---|
| FR | 2623599 | 5/1989 |
| FR | 2608010 | 6/1998 |
| GB | 2230684 | 10/1990 |
| GB | 2299658 | 10/1996 |

* cited by examiner

*Primary Examiner*—Laura Tso
(74) *Attorney, Agent, or Firm*—Michael I Kroll

(57) ABSTRACT

A system for plant illumination that may be installed in or made as part of a planting pot. The system employs a string of illuminable fixtures each having an illumination source. The fixtures may be operated on low voltage that steps down through a transformer and may employ an ambient light sensor. The system may incorporate light globes that protect the illumination sources and may incorporate a transparent color to provide colored light. Light shields may be employed to direct the light from each illumination source. A splashguard may be employed and placed between the illumination source and its respective socket to prevent water from entering the socket. The container may be formed with two walls to protect the wiring being disposed there between.

11 Claims, 11 Drawing Sheets

PLANT AND ROOM ILLUMINATION APPARATUS

BACKGROUND OF THE INVENTION

1. Field of the Invention

The present invention relates generally to illumination devices, and, more specifically, to an illumination system for decorative lighting of plants and/or planting pots.

In one form, the present invention incorporates a string of illumination devices each consisting of an anchor, light, light globe and shield. The string of illumination devices is operated on low voltage that steps down through a transformer. A photo sensor provides means for illuminating said elements based on ambient light. An additional dimmer switch allows the user to set the desired illumination effect.

When energized and placed inside around the perimeter of the potting container, the illuminated lights cast shadows on the surrounding area. The globe shield allows the user to direct the cast of shadows by simply rotating the base unit to a desired position.

In another form of the present invention, the light system is integral to the potting container. The light base is molded on the inner perimeter wall of the container slightly above the soil line. The electrical wiring is protected by being molded within the inner and outer wall of said container.

Each of the aforementioned forms of the present invention may include an additional element comprised of a splashguard. The splashguard provides means to reduce the chance of splashing water into the electrical connection between the bulb and the base. The splashguard may be comprised of an independent shield installed between the bulb and base, or may be molded into the base itself.

2. Description of the Prior Art

There are other illuminating devices and systems. Typical of these is U.S. Pat. No. 2,714,652 issued to Meyer on Aug. 2, 1955.

Another patent was issued to Moore on Jun. 25, 1957 as U.S. Pat. No. 2,797,310. Yet another U.S. Pat. No. 3,015,720 was issued to Silverman on Jan. 2, 1962 and still yet another was issued on May 2, 1989 to Maddock as U.S. Pat. No. 4,826,448.

Another patent was issued to Lovett on Feb. 26, 1991 as U.S. Pat. No. 4,996,636. Yet another U.S. Pat. No. 5,036,447 was issued to Taylor on Jul. 30, 1991. Another was issued to Hall, et al. on Mar. 22, 1994 as U.S. Pat. No. 5,297,013 and still yet another was issued on Apr. 21, 1998 to Lehmann, et al. as U.S. Pat. No. 5,741,061. Another patent was issued to Sanford, Jr. on Mar. 9, 1999 as U.S. Pat. No. 5,879,071. Yet another U.S. Pat. No. 6,076,940 was issued to Sanford, Jr. on Jun. 20, 2000.

Internationally, a United Kingdom patent application was published to Hall on Oct. 31, 1990 as GB2230684. Yet another United Kingdom patent application GB2299658 was published to Plichta on Jun. 23, 1995. A patent in France was issued to Fraysse on Jun. 17, 1988 as Patent No. FR2608010. Another patent in France was issued to Berthelon on May 26, 1989 as Patent No. FR2623599.

U.S. Pat. No. 2,714,652

Inventor: Harry G. Meyer

Issued: Aug. 2, 1955

This invention relates to improvements in illuminated garden ornaments, and more particularly to a novel illuminated garden ornament assembly on a wire adapted to be connected with the house current. An object of the invention is to provide devices of the type, which may be releasably secured to the ground while connected in parallel along an electrical conduit, comprising translucent illuminated ornaments. Another object of the invention is to provide devices of the type, which will be waterproof and otherwise relatively impervious to the elements.

U.S. Pat. No. 2,797,310

Inventor: Walter G. Moore

Issued: Jun. 25, 1957

This invention relates to a portable illuminating device and has particular reference to a simple and novel form of such device that is designated primarily for use in the illumination of gardens, patios, walkways and other areas and it is contemplated that the device shall be arranged in multiple and with the illuminating means embodying shades of various colors to thereby create various ornamental affects. The invention contemplates a novel form of bracket that is constructed in a manner to support a lamp socket and a translucent shade and with the socket and the shade being assembled with respect to the bracket in a simple manner.

U.S. Pat. No. 3,015,720

Inventor: Richard J. Silverman

Issued: Jan. 2, 1962

This invention concerns an improved lantern construction. The invention is particularly directed at a novel support for a wired electric lantern so arranged that a post forming part of the support can be thrust into the ground in an upright position, and a lamp having a novel splined bushing can be inserted into the post without in any way disturbing the wiring of the lamp. The post is provided with telescopically attached sections for adjusting the height of the post at will. It is therefore one object of the invention to provide an electric lamp support with a splined tubular bushing independent of the wiring of the lamp. It is another object to provide a support for an outdoor lantern including a plurality of telescopically engaged cylindrical sections and a lamp having a splined bushing inserted in a free end of one section for supporting the lamp.

U.S. Pat. No. 4,826,448

Inventor: William H. Maddock

Issued: May 2, 1989

An electrical connector includes stab portions and a cam for urging a wire cord into contact therewith. The cam mounts in a tubular housing, which is telescopically receivable in a sleeve. The cam and housing coact such that the cam head tends to move outwardly from the housing when the cam is moved to a position to release the wire cord, and this is prevented by the sleeve. As a corollary, if the cam is turned away from its wire locking position, the housing cannot be engaged with the sleeve. The sleeve acts as a conduit for the wire cord, whereby the cord tends to anchor the housing in telescoped position in the sleeve, to prevent unauthorized tampering with the connector.

U.S. Pat. No. 4,996,636

Inventor: Robert H. Lovett

Issued: Feb. 26, 1991

A low voltage light fixture for use with a multi-conductor wire, includes a base, a lens supported by the base, a pair of electrical conductors supported by the base which form a light bulb receptacle at their upper ends and wire engaging prongs at their lower ends, and a stake or post for supporting the base. A twist lock connector mechanism connects together the base, the stake and the wire.

U.S. Pat. No. 5,036,447

Inventor: Beverly W. Taylor

Issued: Jul. 30, 1991

A stake supports an outdoor lighting fixture. The light fixture includes a socket for a light bulb, and electrical wires connected to the socket. The stake has a stem insertable into the ground. An improvement comprises a housing having an opening in its upper end. The height of the housing is such that the socket fits within the housing when the fixture is installed on the stake. The light bulb protrudes through the opening in the upper end of the housing when the socket is so installed. One side of the housing has an opening to allow insertion and removal of the socket. The housing has horizontal slots in its respective side walls to support the wiring for the fixture.

U.S. Pat. No. 5,297,013

Inventor: Milly S. Hall, et al.

Issued: Mar. 22, 1994

An outdoor light fixture that has a cover with a clear pane and an inner refracting lens adapted to refract light emitted from a light source and to fit over the light source.

U.S. Pat. No. 5,741,061

Inventor: Robert W. Lehmann, et al.

Issued: Apr. 21, 1998

A planter which includes at least one light source such that light emitted by the light source may illuminate a plant contained within the planter and also illuminates the floor on which the planter rests. The light illuminating the plant is directed at an upward angle to efficiently illuminate the plant in an aesthetically pleasing manner.

U.S. Pat. No. 5,879,071

Inventor: Sammie J. Sanford, Jr.

Issued: Mar. 9, 1999

A lighted planter includes a container having a bottom and side walls and an opening formed by the walls and spaced from the bottom wall. The side walls include a generally horizontally extending edge portion adjacent the opening and a light source integral with the edge portion providing upwardly projecting illumination to directly light a plant planted therein.

U.S. Pat. No. 5,879,071

Inventor: Sammie J. Sanford, Jr.

Issued: Jun. 20, 2000

A lighted planter includes a container having a bottom and side walls and an opening formed by the walls and spaced from the bottom wall. The side walls include a generally horizontally extending edge portion adjacent the opening and a light source integral with the edge portion providing upwardly projecting illumination to directly light a plant planted therein.

United Kingdom Patent Number GB2230684

Inventor: Nigel Hall

Published: Oct. 31, 1990

A plant holder, e.g. a plant pot 1, provides means for illumination of the plant or plants contained within the plant holder for the purpose of decorative lighting. The plant holder provides at least one light source, e.g. a plurality of incandescent bulbs 6 and 7, retained adjacent the outer edge of the plant holder, at or near the top of the plant holder. Each incandescent bulb 6 or 7 is secured and electrically supplied via a conventional bayonet type holder 4 or 5, and is enclosed by bulbous shaped enclosure means 8 or 9 retained adjacent the outer surface of the pot 1 therefore forming a cavity 22 or 23. The cavity 22 or 23 further has an aperture 10 or 11, such that substantially all the light emitted by the bulb 4 or 5 will illuminate the plant or plants contained within the plant holder.

United Kingdom Patent Number GB2299658

Inventor: Wojtek Plichta, et al.

Published: Oct. 9, 1995

A decorative lighting arrangement includes a support, especially a stake driven into the ground, and a lighting fixture including a socket and a light bulb mounted in the socket. A coupling connects the lighting fixture to the support so that the light bulb and at least a predominant portion of the socket are disposed upwardly of an upper region of the support to be visible thereat. The coupling includes a coupling element forming an integral part of the support, and a coupling portion connected with the socket. The coupling element includes a platform and an upstanding rim peripherally surrounding a portion of the platform. The coupling portion at least frictionally engages the platform and the rim of the coupling element to retain the lighting fixture in position on the support. The rim of the coupling element includes respective open-ended slots for the passage of electric wires of the lighting fixture. The surfaces bounding such slots frictionally engage the wires to obtain the retaining effect. The coupling portion may include a generally hook-shaped projection integral with and extending upwardly from the bottom portion of the housing to be introduced into an opening of the rim to engage the latter. Alternatively, a decorative element has the lighting fixture mounted thereon and includes a base that constitutes the coupling portion. The base includes a bottom wall and two upstanding lateral walls flanking the bottom wall at its opposite sides. The rim of the coupling element has a cantilevered portion that overhangs the platform and bounds therewith a channel for receiving, guiding and frictionally engaging the lateral walls of the base.

France Patent Number FR2608010

Inventor: Jacques Fraysse

Published: Jun. 17, 1988

The invention relates to a device for supporting and illuminating plants in pots or window boxes. It consists of a tube 1 of transparent rigid plastic in which a low-consumption lighting line 2 composed of little lights (fireflies) 3 is placed, connected to the electrical power system via a lead 5 terminated by a power plug 6, and of a flange 7 preventing any contact between the electrical system and the soil. This flange is placed at approximately one third of the lower part of the tube. The part of the tube beneath the flange is free of any electrical system and is closed off by an end-piece 8, and is intended to be pushed into the soil. Placed as a standard stake, it completely fulfils its role of supporting the plant, the illuminating line inserted into the tube allows constant and diffuse lighting from the bottom right up to the top of the stake. The device according to the invention is particularly intended for supporting and illuminating plants in pots or window boxes, which are in locations lacking light.

France Patent Number FR2623599

Inventor: Michel Berthelon

Published: May 26, 1989

Luminous support of the tubular type, consisting of a central translucent plastic tube 1 incorporating electric bulbs 5 of elongate shape mounted in series and supplied by an electric wire with two conductors, and a translucent tubular sheath 2 engaged around the central tube and fixed thereto by adhesive bonding points, this sheath 2 making between it and the latter 1 passages which allow a flow of cooling air. This luminous support is adapted in particular for ornamental houseplants in order to supply them, in addition to rigid support, with background lighting, which promotes their growth.

While these illumination devices and systems may be suitable for the purposes for which they were designed, they would not be as suitable for the purposes of the present invention, as hereinafter described.

SUMMARY OF THE PRESENT INVENTION

A primary object of the present invention is to provide a plant illumination apparatus and system that comprises a plurality of illuminable devices.

Another object of the present invention is to provide said apparatus and system that comprises a plurality of illuminable devices which consist of an anchor, light, light globe and shield.

Still yet another object of the present invention is to provide said apparatus and system that are electrically interconnected.

Yet another object of the present invention is to provide said apparatus and system that utilizes a transformer for a low voltage power circuit.

Still yet another object of the present invention is to provide said apparatus and system that utilizes a photo sensor to provide means for illuminating said elements based on ambient light.

Still yet another object of the present invention is to provide said apparatus and system that utilizes a dimmer switch to allows the user to set the desired illumination effect.

Yet another object of the present invention is to provide said apparatus and system that allows the user to rotate the shield allowing the user to direct the cast of shadows by simply rotating the base unit to a desired position.

Still yet another object of the present invention is to provide another form of the present invention in that the light system is integral to the potting container.

Yet another object of the present invention is to provide said apparatus and system that can utilize a splash guard to provide means to reduce the chance of splashing water into the electrical connection between the bulb and the base.

Still another object of the present invention is to provide said splash guard composed of an independent shield installed between the bulb and base, or molded into the base.

Another object of the present invention is to provide said apparatus having color lights that may be used.

Still yet another object of the present invention is to provide said apparatus having differently colored lenses or globes.

Yet another object of the present invention is to provide said apparatus having a fixed or variable voltage to power the device.

Another object of the present invention is to provide said apparatus that may include spotlights for illumination.

Still yet another object of the present invention is to provide said apparatus that may include florescence for illumination.

Yet another object of the present invention is to provide said apparatus that may include snake lighting for illumination.

Another object of the present invention is to provide said apparatus having photo sensors for turning on in the dark.

Still yet another object of the present invention is to provide said apparatus having sensors for timing a lighting process.

Yet another object of the present invention is to provide said apparatus having lights that may change color.

Another object of the present invention is to provide said apparatus having lights that can spin.

Still yet another object of the present invention is to provide said apparatus having light utilizing reflective properties of mirrors.

Yet another object of the present invention is to provide said apparatus having lights shining through crystal to produce patters of projected light.

Another object of the present invention is to provide said apparatus having lighting to produce an advertisement.

Still yet another object of the present invention is to provide said apparatus having lights that promote plant health.

Yet another object of the present invention is to provide said apparatus having a light that emits a pleasant odor.

Another object of the present invention is to provide said apparatus having differentiating sizes of pots and lights.

Still yet another object of the present invention is to provide said apparatus that may be utilized indoors or outdoors.

Yet another object of the present invention is to provide said apparatus having lights that play music.

Another object of the present invention is to provide said apparatus having lights that turn on due to motion detection.

Still yet another object of the present invention is to provide said apparatus having lights turned on by a switch.

Yet another object of the present invention is to provide said apparatus having lights turned on by solar power.

Another object of the present invention is to provide said apparatus having lights that turn on by a dimmer switch having variable brightness.

Still yet another object of the present invention is to provide said apparatus having lights that kill or repel insects.

Yet another object of the present invention is to provide said apparatus made in a trough like structure comprised of a different material.

Another object of the present invention is to provide said apparatus having a structure that may be a container or part of a container with lights.

Still yet another object of the present invention is to provide said apparatus having lights on a stand or frame.

Yet another object of the present invention is to provide said apparatus having lights utilizing focusing lenses and colored slides.

Another object of the present invention is to provide said apparatus having an LED to produce lighting.

Still yet another object of the present invention is to provide said apparatus having lighter lights that flicker.

Yet another object of the present invention is to provide said apparatus having the ability to add additional lights.

Another object of the present invention is to provide said apparatus having a container that may rotate.

Still yet another object of the present invention is to provide said apparatus having a container that may oscillate.

Yet another object of the present invention is to provide said apparatus having a rotating or oscillating container and stationary lights.

Another object of the present invention is to provide said apparatus having rotating or oscillating lights and a stationary container.

Still yet another object of the present invention is to provide said apparatus having a container operable by remote means.

Yet another object of the present invention is to provide said apparatus having a swag chain having a light.

Yet another object of the present invention is to provide said apparatus having a swag chain having a rope light.

Yet another object of the present invention is to provide said apparatus that may be constructed and used with any combination of the above.

Additional objects of the present invention will appear as the description proceeds.

The present invention overcomes the shortcomings of the prior art by providing improved means and methods of decorative and artistic display of potted plants and the shadows and atmosphere created when illuminated by a plurality of lights.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which FIG. 1 is an illustrative view of the present invention in use.

LIST OF REFERENCE NUMERALS

Figure 1:
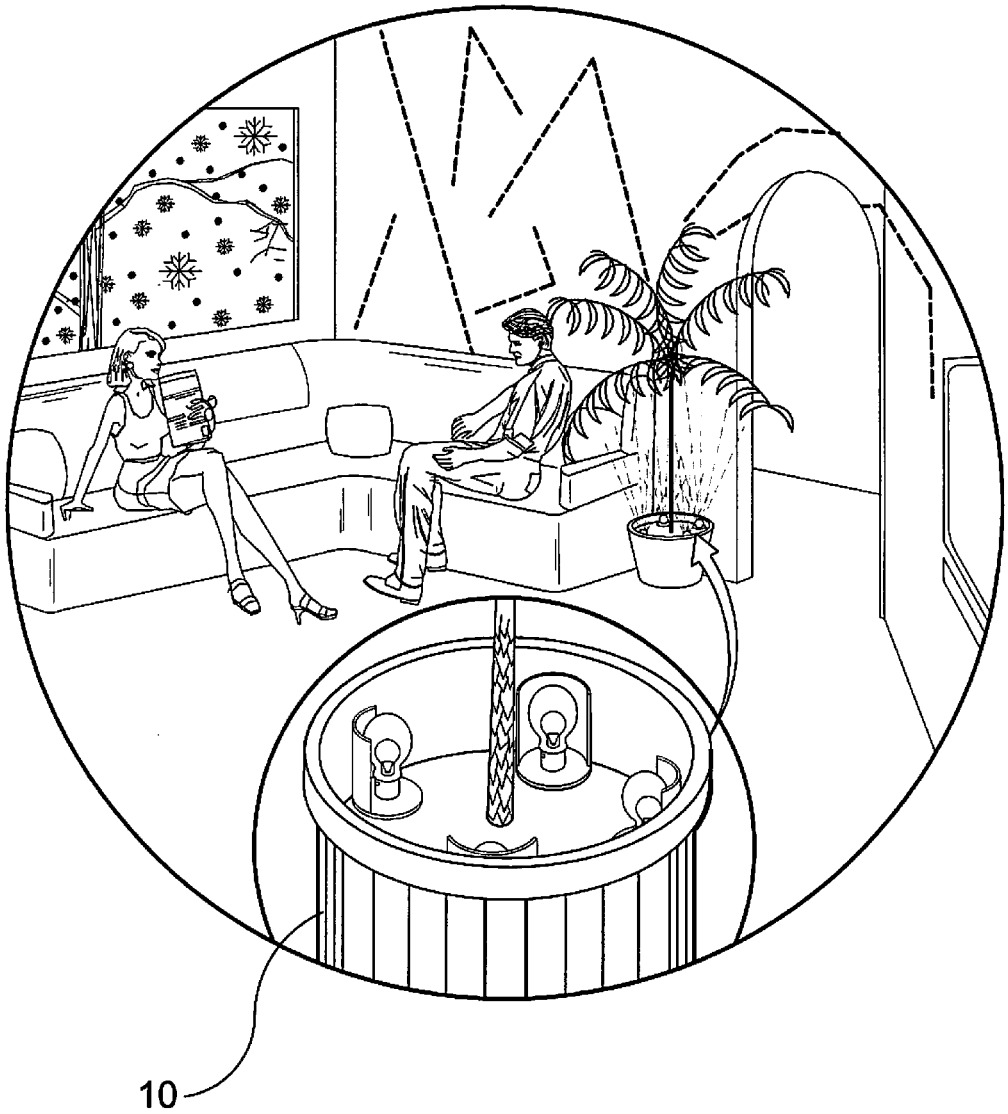

With regard to reference numerals used, the following numbering is used throughout the drawings.

10 Present Invention
12 Light Bulb
14 Light Globe
16 Light Shield
18 Photo Sensor
20 Socket
22 Base
24 Plant
26 Plant Container
28 Transformer
30 Support
32 Wiring
34 Connector
36 Drip Barrier Contour
38 Sidewall
40 Soil Level
42 Splash Guard
44 Control Mechanism
46 Reflective Material
48 Bottom
50 Lens
52 Plug

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Turning now descriptively to the drawings, FIGS. 1-13 illustrate a plant and room illumination apparatus of the present invention, which is generally indicated by reference numeral 10.

FIG. 1, is an illustrative view of the present invention 10 in use. The present invention 10 is a plant and room illumination apparatus comprising a plurality of illuminable fixtures where each fixture includes an anchor 30, a socket 20, a base 22, a light bulb 12 or other illumination source, a light globe 14, and a light shield 16. The light globe 14 provides protection to the light bulb 12 or to the illumination source. The light globe 14 is preferably made of a durable plastic material that is capable of with standing the heat generated by the light bulb 12 or illumination source yet allowing the light from the source to pass there through. The plastic may be transparent (i.e. clear or without color), the plastic may be translucent, or the plastic may be colored or tinted to give off colored light. It is envisioned that the colored or tinted light globes 14 would be translucent to allow the light from the bulb 14 or source to pass there through. The light globes 14 may employ any color, which may be desired by the user. The light globes 14 may be all of the same color or be different colors depending on the desires of the user. A strand of lights may employ light globes 14 with a plurality of colors or a single color. It is envisioned that the light globes 14 may be easily changed or replaced by the user depending on their needs. The light globe 14 protects the light bulb 12 from contact with water, debris, and from contact with a user. The present invention 10 incorporates a photo sensor 18 that detects the amount of ambient light available and turns on the lights when the ambient light drops is at or below a set level and turns off the lights when the ambient light is above a set level. The photo sensor 18 is essentially a switch controlled by an ambient light sensor. The photo sensor 18 continually detects the amount of ambient light available and turns on the lights when the amount of ambient light drops to or below an established level or threshold. The anchor 30 is designed to support its attached fixture in an upright position when the support is placed or inserted into the soil in the plant container. The support 30 may be in the form of a stake that is stuck or inserted into the soil in the container. The anchor 30 may also be a threaded anchor that may be screwed into the soil to provide a more positive means for anchoring the each fixture.

Figure 2:
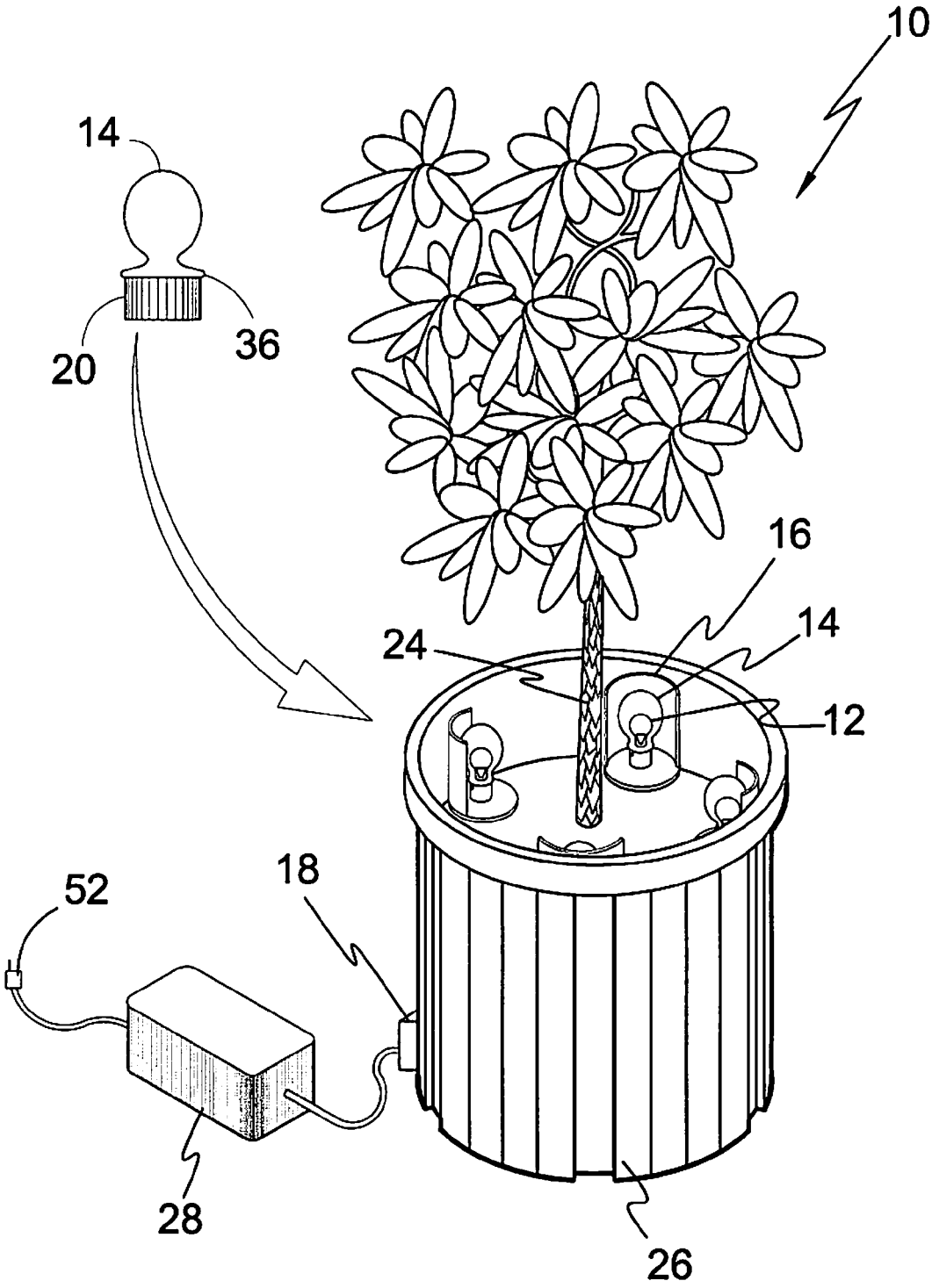
FIG. 2 is an illustrative view of the present invention in use.

FIG. 2, is an illustrative view of the present invention 10 in use. Shown is one embodiment of the present invention 10, a plant and room illumination apparatus comprising a plurality of illuminable fixtures connected by electrical wiring 32. A strand or string of lights includes a plurality of illuminable fixtures secured together by appropriate wiring 32 or a suitable power cord. It is envisioned that the fixtures may be permanently secured to the wiring 32 or cord in such a manner that they are not removable from the wiring 32 or cord or they may be made so that they can be quickly and easily attached and removed from the wiring 32 or the cord. It is envisioned that the apparatus employ a transformer 28 and the light bulbs 12 are powered by low voltage to reduce the potential injury to a user. Low voltage is well known in the electrical arts. It is also envisioned that the apparatus may employ a control mechanism 44 which is capable of turning on and off the lights in sequence or other manners to include but not limited to flashing or flickering. Each light shield 16 aids in directing the light away from its respective light bulb 12 or illumination source. The light shields 16 may be opaque and will block light from passing there through. In addition the light shields 16 may be provided with a reflective material 46 to aid in directing light away from the shields 16. The light shields 16 seen in FIG. 2 have a curved or arcuate light-directing surface. This surface focuses and directs light away from the shield. The light-directing surface is the surface that faces the light bulb 12 and light globe 14. It is also envisioned that the base 22 may employ a reflective coating in its upper surface. This will aid the base 22 is directing and focusing light upwards and away from the upper surface of the base 22. The bases 22 are shown as being substantially planar surfaces but may employ a curved or parabolic surface for directing or focusing the light from the illumination sources. It is also envisioned that the reflective surface of the bases 22 and the shields 16 may be smooth or in the alternative may employ a rough or irregular surface. The rough or irregular surface will tend to diffuse any light reflected there from. The reflective surfaces of the shields 16 and the bases 22 send light upward and outward away from the light bulbs 12. It is envisioned that the shields 16, the bases 22, and the supports 30 be made from a durable plastic material and may be molded together in one piece or they may be formed of individual pieces joined or secured together. In the alternative the light fixtures (shield, base and supports) may be made of a metal or any other suitable material.

Figure 3:
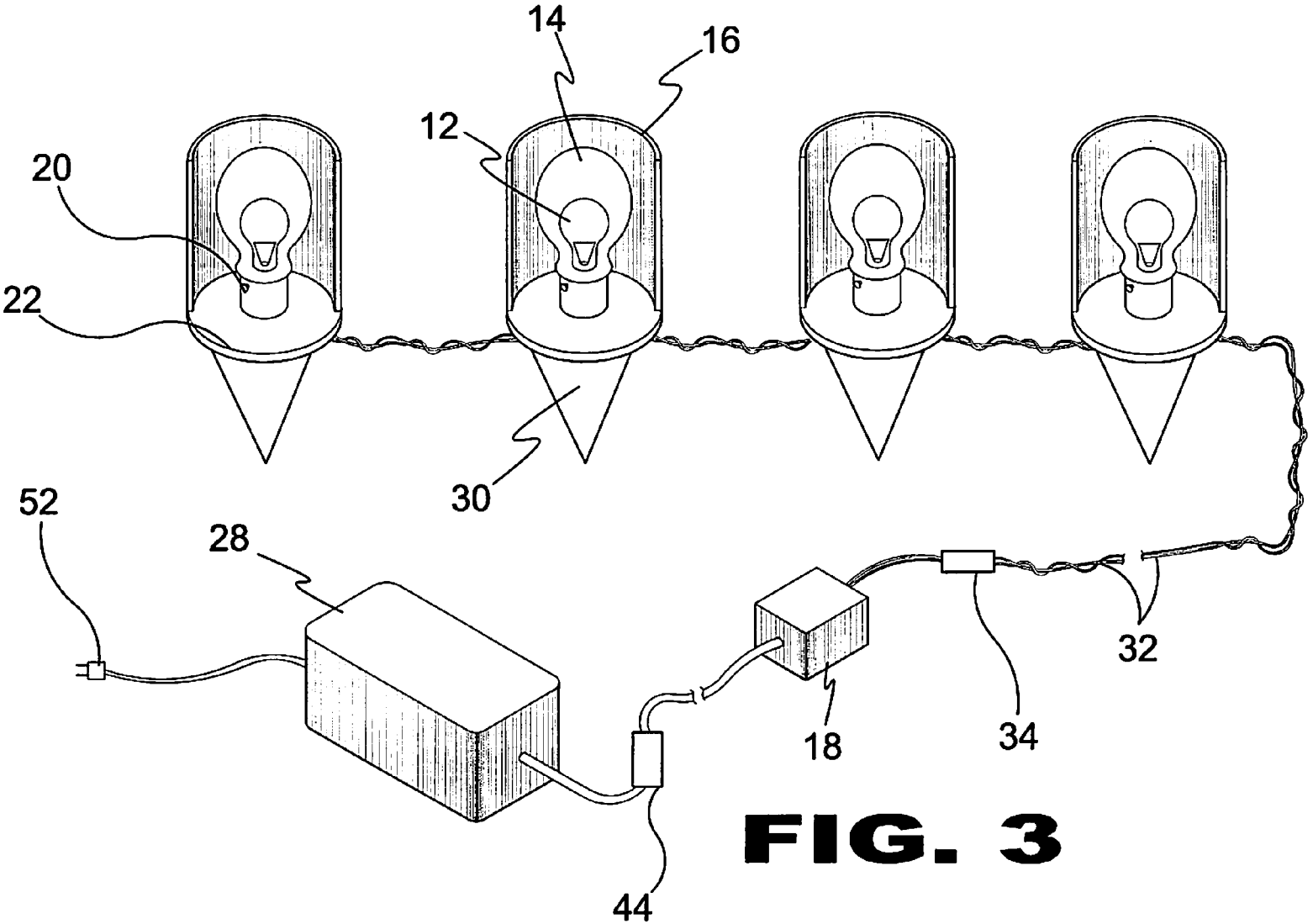
FIG. 3 is a perspective view of the present invention.

FIG. 3, is a perspective view of the present invention 10. Shown is a string or stand of lights of the present invention 10. The strand of lights includes a plurality of illuminable fixtures, a power cord or wiring 32 interconnecting the fixtures, a photo sensor 18, and a transformer 28. The strand of lights is for use with an existing plant container 26 or may be formed as part of a plant container 26 (see FIGS. 8 and 9). Either embodiment employs a plurality of illuminable fixtures each fixture having a support 30 secured thereon or formed therein. In the first embodiment the supports 30 are separate from the plant container 26 and are capable of holding the fixture upright when the support 30 is inserted into the soil in the plant container 26. In the second embodiment the supports 30 are formed as part of the plant container 26. The supports 30 secure the light sockets 20 to the plant container 26. Either embodiment may employ a photo sensor 18, a transformer 28, and a control mechanism 44. The control mechanism 44 is capable of performing a variety of special effects such as but not limited to varying the intensity of each light bulb 12 (i.e. dimming), causing the light bulbs 12 to flicker or flash, causing the light bulbs 12 to light in a particular sequence, or any combination thereof. It is envisioned that the control mechanism 44 employ a microprocessor that is user programmable to allow the user to control the lights as desired. The support 30 or anchor in the first embodiment may simply be a stake that is inserted into the soil (commonly referred to as potting soil) that is disposed in plant container 26. It is also envisioned that the support 30 may be a screw support or anchor that has a threaded portion that is screwed into the soil in the plant container 26. Each support 30 is capable of supporting its respective fixture in an upright position when the support 30 is inserted or placed into the soil in the plant container 26.

Figure 4:
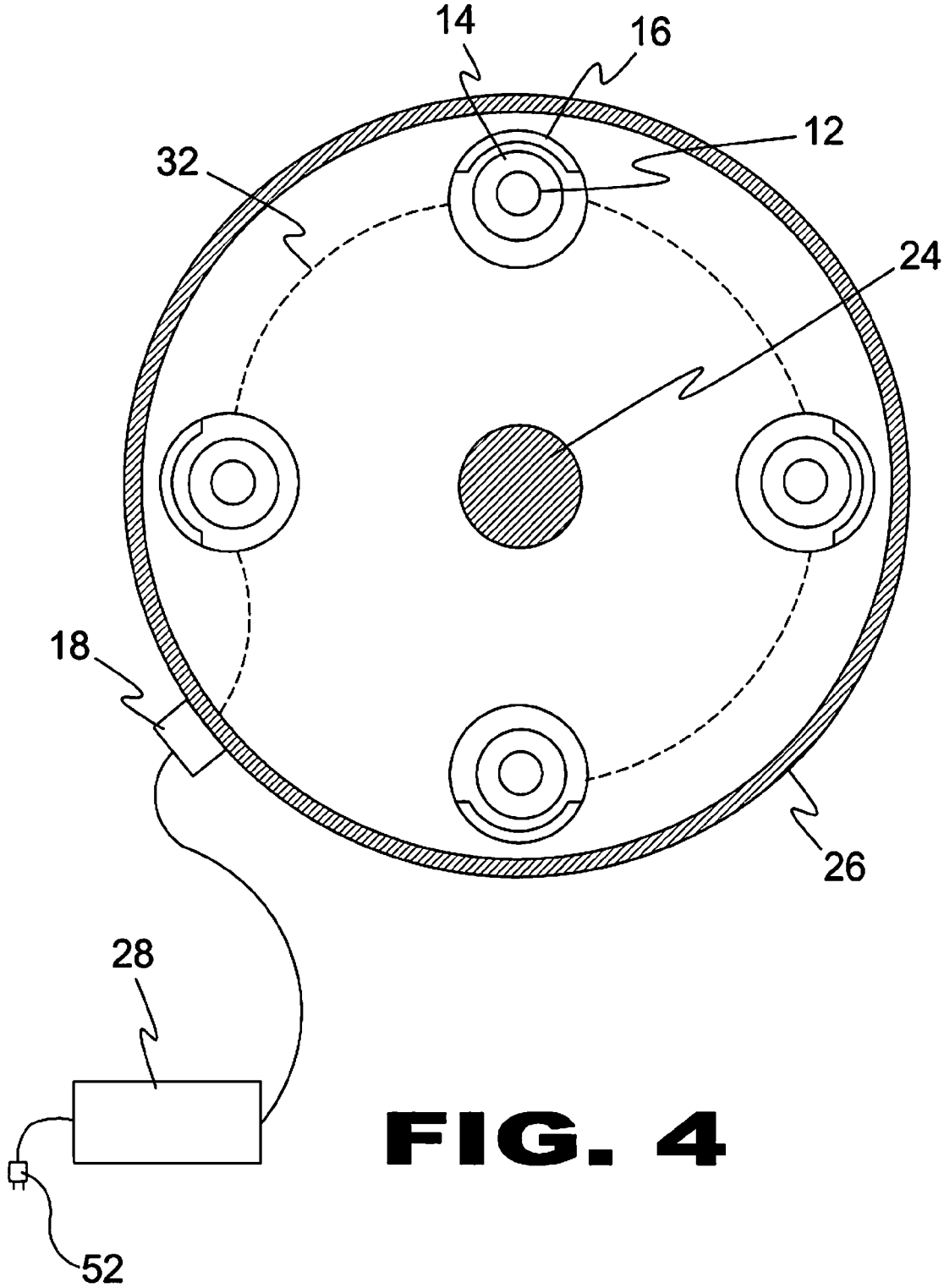
FIG. 4 is a top view of the present invention.

FIG. 4, is a top view of the present invention 10. Shown is a strand of lights that is separate from the plant container 26. The strand are typically employed with or retrofitted into an existing plant container 26. The transformer 28 and the photo sensor 18 are shown on the exterior of the container 26 but may be located inside the container 26. The transformer 28, the photo sensor 18, and wiring 32 will be fully waterproof when they are intended to be placed inside the container 26 to prevent the possibility of damage when the plant 24 is watered. It is envisioned that the device may also include a Ground Fault Interrupt (GFI) to prevent the possibility of electrical short circuit in the wet environment. The GFI may be incorporated into the plug portion of the electrical cord. It is known to provide a GFI in the portion of the cord that plugs into the outlet. The GFI may be positioned between the outlet and the transformer. The photo sensor 18 is shown as being positioned on the exterior surface of the container sidewall 38 and is attached to the wiring 32 or cord between the transformer 28 and the light fixtures. It is envisioned that the photo sensor 18 may be positioned in other locations as desired by the user. It is also envisioned that the photo sensor 18 may be intergraded into or made part of the transformer 28. It is preferable that the photo sensor 18 will be positioned in an exposed surface of the transformer 28 to ensure that it will be exposed to the ambient light of the room in which it is located. It is also envisioned that the photo sensor 18 may be positioned in the wiring 32 or cord between the transformer 28 and the plug 52. The plug 52 is the part of the cord that plugs into the household outlet. The photo sensor 18 is preferably located so that it is not affected by the light from the light bulbs 12. It is desirable to place the sensor 18 such that when the lights bulbs 12 are illuminated they do not cause the photo sensor 18 to turn them off.

Figure 5:
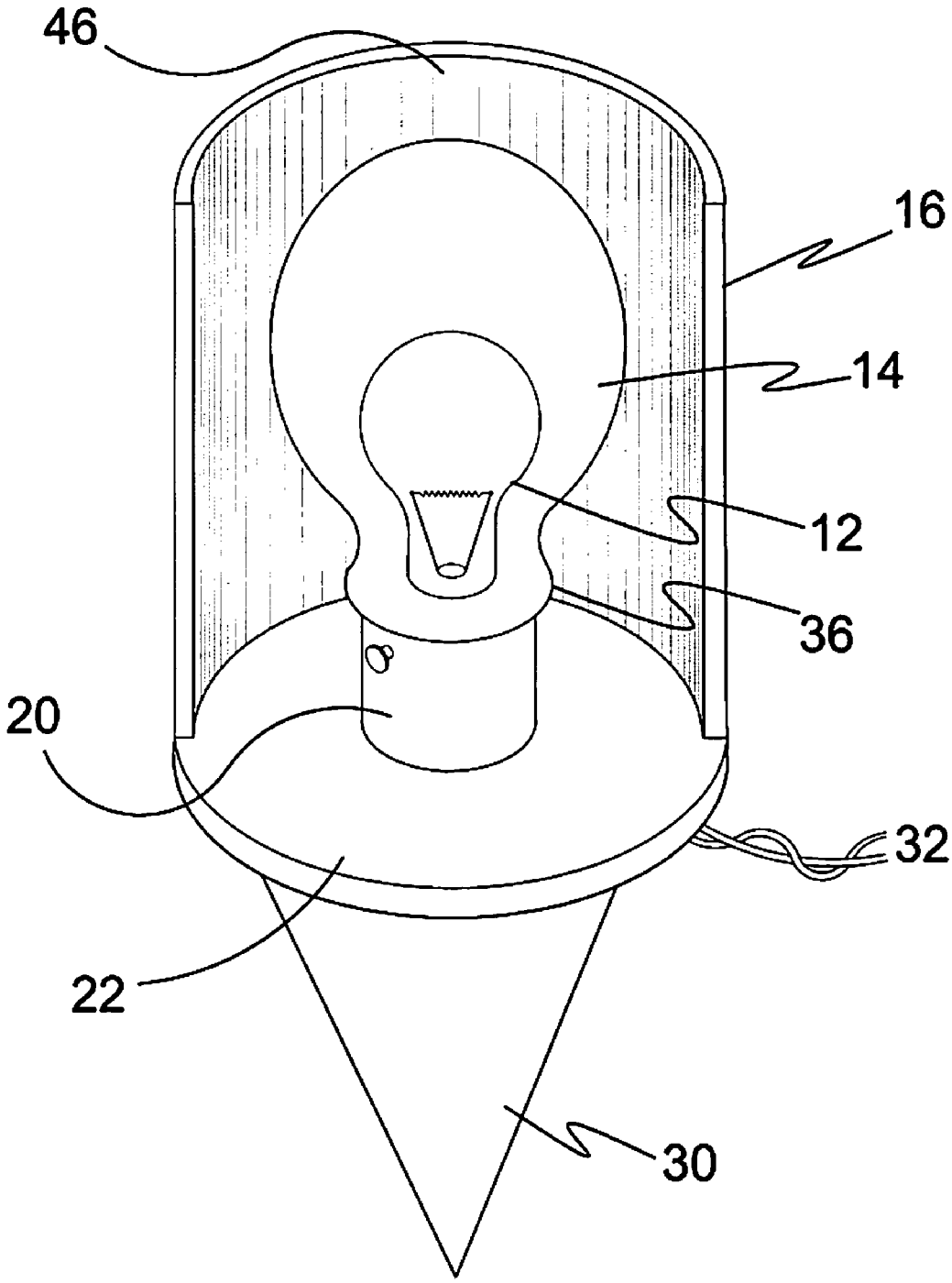
FIG. 5 is a front perspective view of a single light unit of the present invention.
Figure 6:
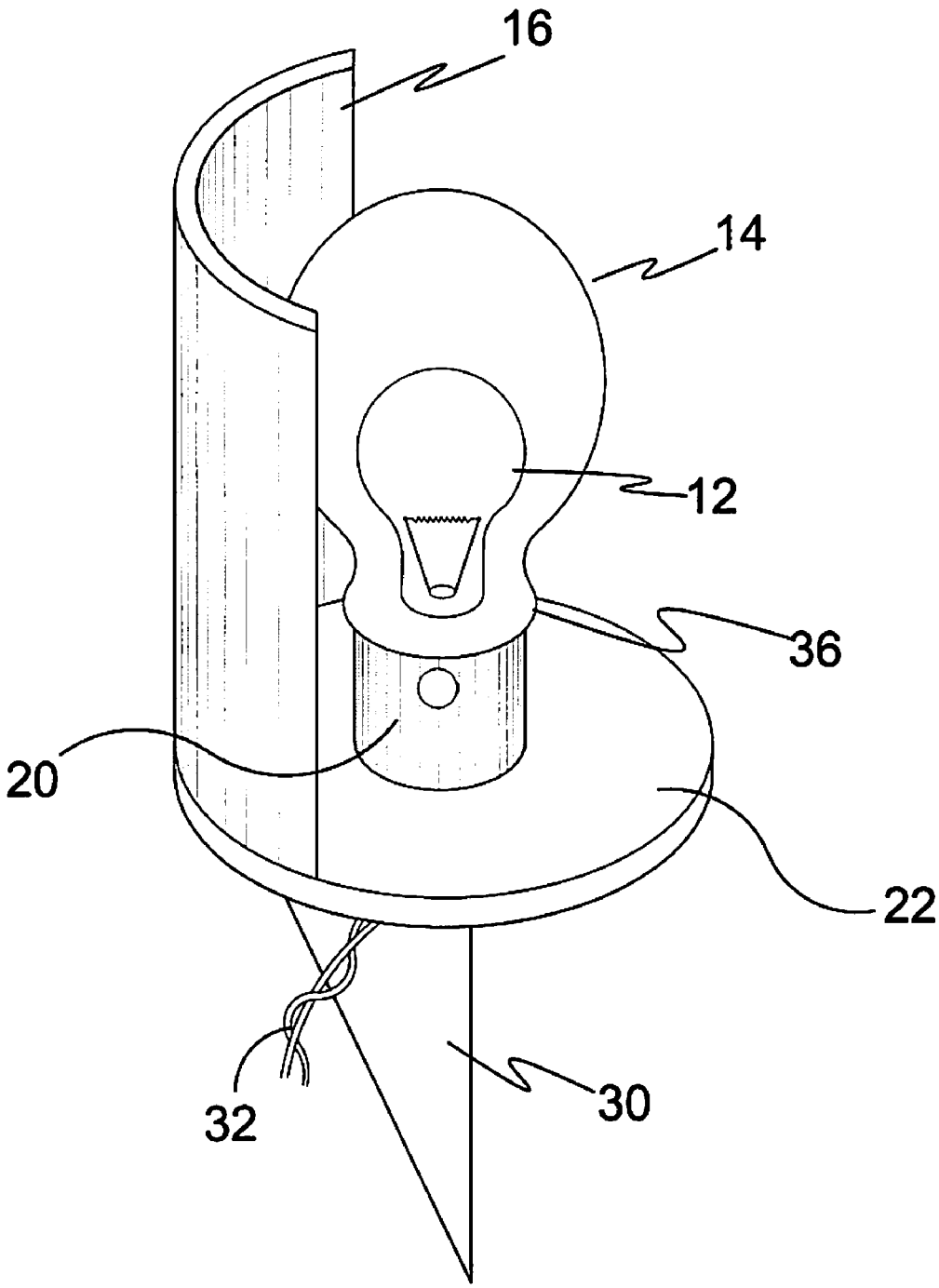
FIG. 6 is a side perspective view of a single light unit of the present invention.

FIGS. 5 and 6 are perspective front and side views (respectively) of a single light fixture of the present invention 10. The single light fixture is one of a plurality of fixtures on a strand or string of lights. The strand or string of light fixtures is for use with or may be retrofitted into an existing plant container 26. It is envisioned that the user will be required to make a hole in the sidewall 38 of the container 26 to allow the cord or wiring to pass there through. It is not necessary to have the cord pass through the container 26 but may be desirable since it will hide the wiring 32 or cord. It is envisioned that the user employ a gasket or caulk to seal the hole made in the container 26. It is envisioned that the cord or wiring 32 may be provided with a connector 34 (see FIG. 3) that is waterproof to allow the user to separate the cord or wiring 32 into two pieces. Thus making it easier to pass the wiring 32 through the hole or opening in the container 26. The connector 34 will be readily separable to allow the user to pass one part of the connector 34 through the hole or opening and then connect it to the other part of the connector 34 secured to or formed in the other part of the cord or wiring 32. Thus the user only has to make a hole large enough to allow the connector 34 to pass there through. The user will then seal the opening in the container 26 to prevent water from leaking there through when the plant 24 is watered. The container 26 will typically be modified when empty. Once the caulk or other sealant has dried the user can place a plant and its associated potting soil in the container 26 and distribute the light fixtures about the container 26 as desired.

Figure 7:
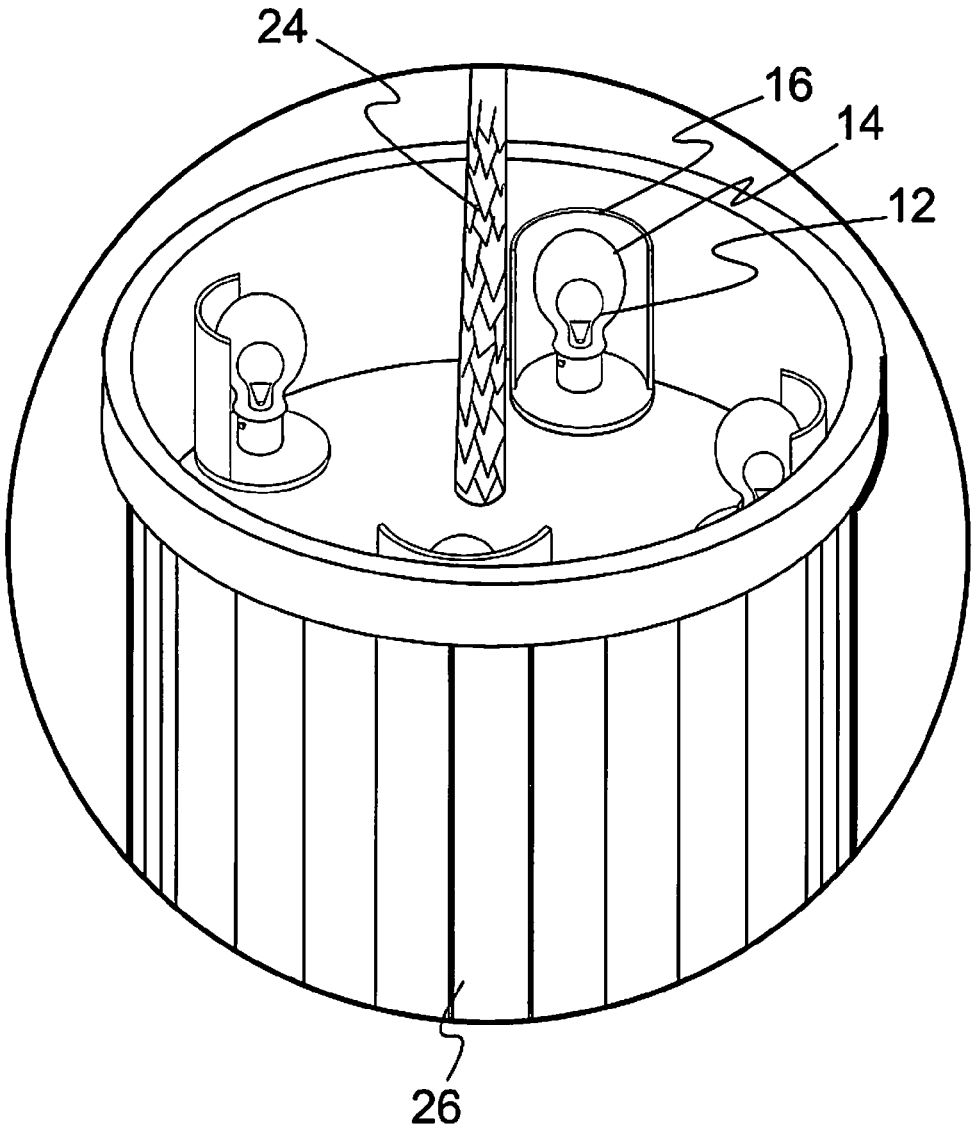
FIG. 7 is a detailed view of the present invention.
Figure 7A:
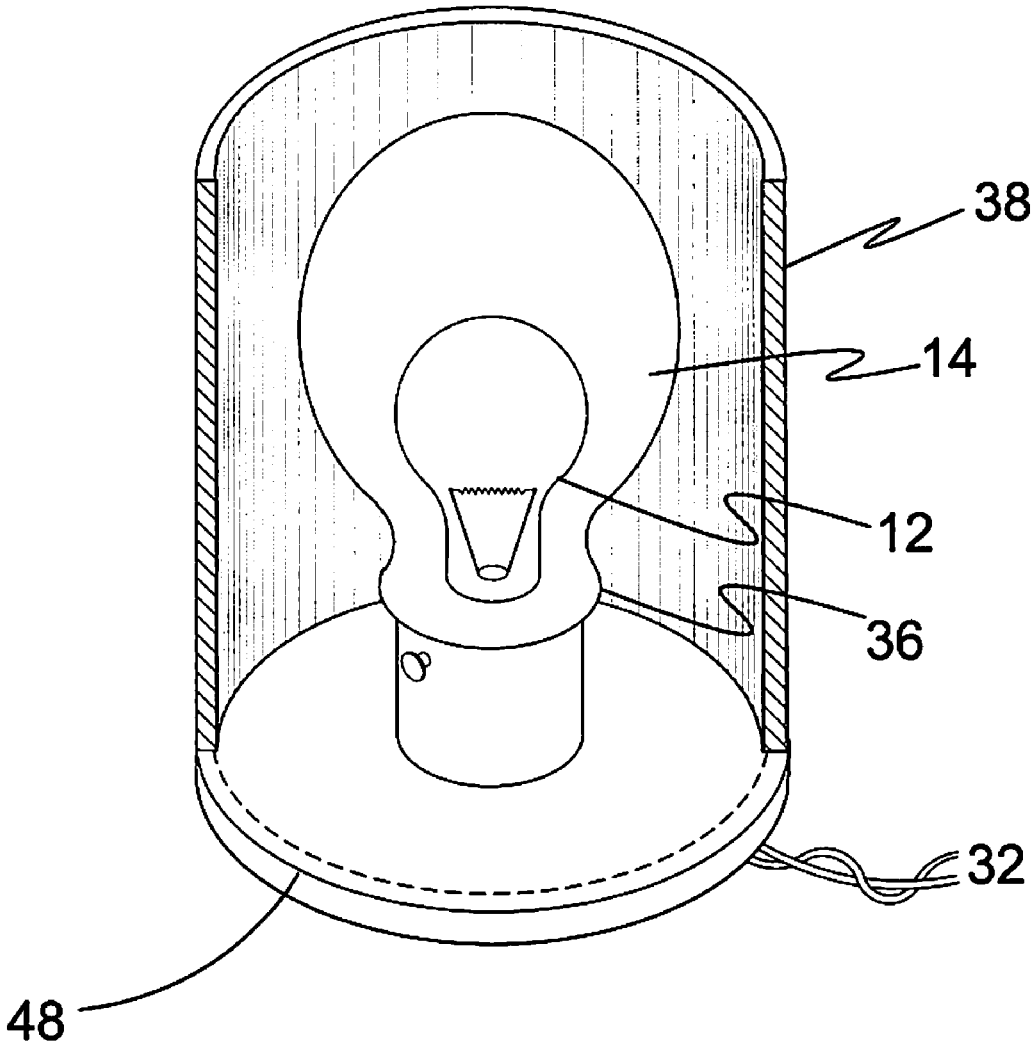
FIG. 7A is a sectional view of the present invention.

FIG. 7, is a detailed view of the present invention 10 showing how the fixtures are positioned within an existing plant container 26. The fixtures are preferably positioned so that the light shields 16 are spaced from the sidewall 38 of the container 26. This prevents or ensures that that the light shields 16 are not in contact with the sidewall 38 of the container 26. The plant container 26 plastic may not be heat resistant and may be melted by the heat generated by the light bulbs 12. It is envisioned that the bulbs 12 may be incandescent, florescent, light emitting diodes (LEDs), or any other suitable type of bulb 12. It is also envisioned that the present invention 10 may employ a string or strand of interconnected light sources that are protected by a sealed plastic tube or casing. These are some times referred to as rope lights. The rope light will not have light fixtures or anchors. The rope light will have a tube or casing having sealed ends and a plurality of light sources disposed therein. The light sources will be connected by a cord or wiring 32 inside the tube or casing. The cord or wiring 32 passes through the casing and has an end with a plug that is outside of the casing so that it can be connected to a household outlet. It is envisioned that the rope light may or may not employ a transformer 28. The rope light may employ a photo sensor 18, a control mechanism 44, and a connector 34. The connector 34 is, as previously discussed, waterproof and enables the user to install the rope light through the sidewall 38 of the plant container 26. The connector allows the user to make a smaller hole in the container 26. The hole will be only slightly larger than the outer diameter of the connector 34. It is envisioned that the connector 34 in the rope light will be outside the tube or casing and the rope light may employ a control mechanism 44 that is user programmable and may include a microprocessor. The base 22 and the light shield 16 of each fixtures are shown as being positioned above the soil level 40 in the container 26 since the fixtures are open are designed to be positioned above the soil level 40. Only the support 30 or anchor is intended to be buried in the soil. It is envisioned that the fixtures may be provided that are designed to be buried in the soil to make them less obtrusive (FIG. 7A). They would employ a peripheral sidewall 38 and a closed bottom 48 with a light bulb 12 or light source disposed therein. A transparent lens 50 may close the open end of the fixture and prevent moisture and soil from entering. This would enable the fixture to be positioned so that the lens 50 is flush or nearly flush with the soil level 40. The lens 50 may be provided with a sealing means that is capable of providing a watertight seal between the lens 50 and the fixture. The lens 50 functions as a closure to protect the contents of the fixture. The lens 50 may be made from a transparent, or translucent material such as plastic or glass. It is also envisioned that the lens 50 may in corporate a color or tint in the same manner as the light globes 14 previously discussed. It is preferable that the lens 50 incorporates a transparent color so that colored light is emitted there from.

Figure 8:
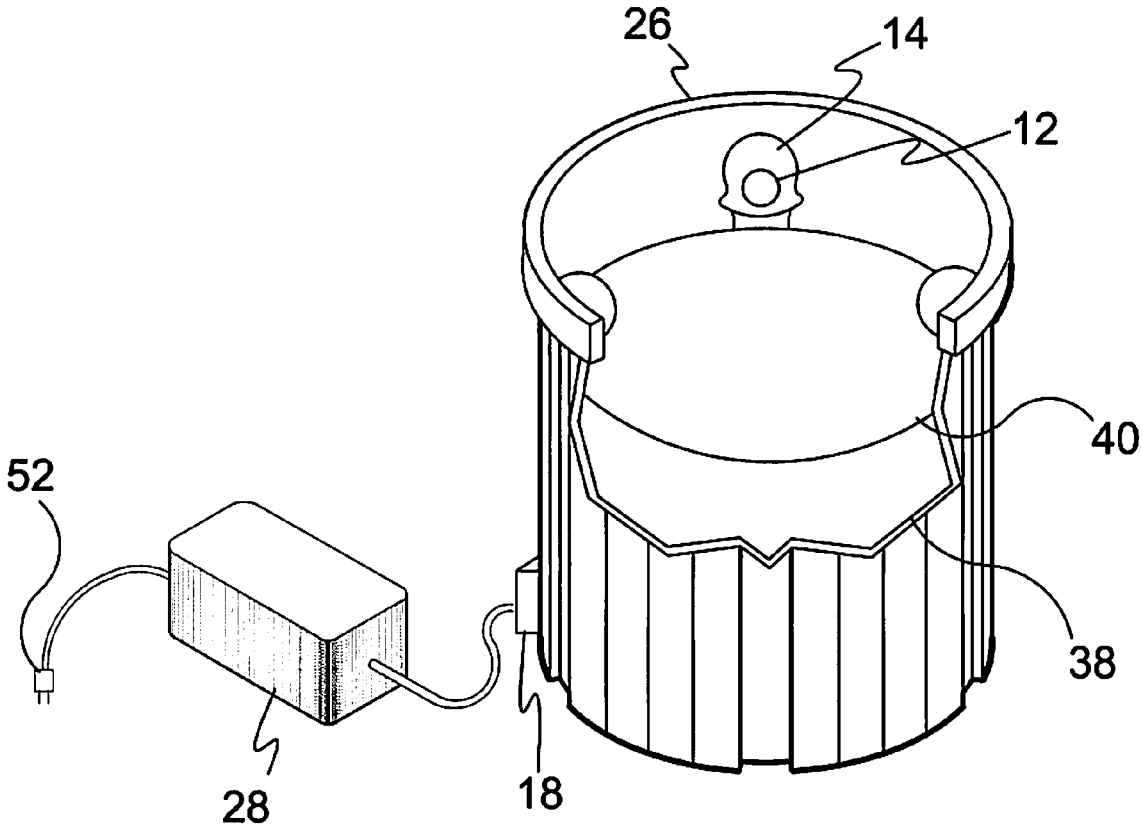
FIG. 8 is an illustrative view of the present invention in use.
Figure 9:
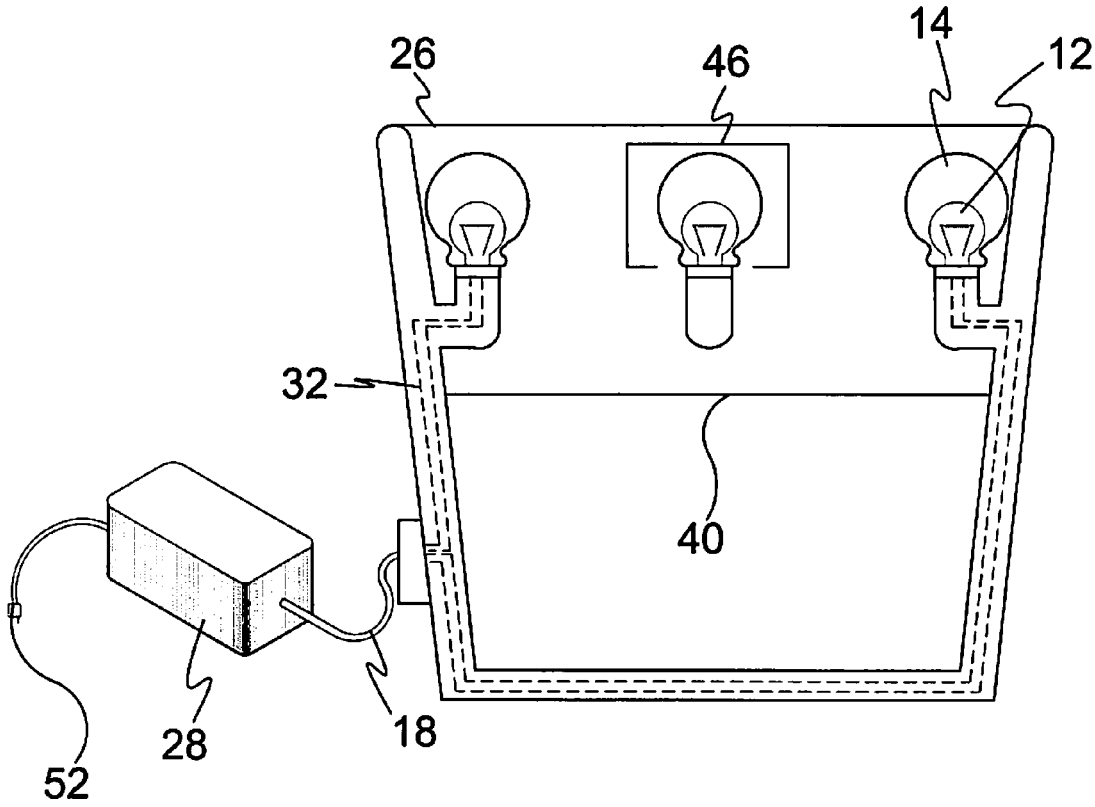
FIG. 9 is a sectional view of the present invention in use.

FIGS. 8 and 9 are illustrative views of another embodiment of the present invention 10. In this embodiment, the container 26 has integral illuminable fixtures formed therein or secured thereon. The container 26 and its integral lighting system may include an photo sensor 18, a transformer 28, and a control mechanism 44 as with the previous embodiment. It is preferred that the photo sensor 18 is located on the exterior surface or sidewall 38 of the container 26 so that it is not affected by the light from the fixtures. In this embodiment the support 30 is an extension of the sidewall 38 and secures the light socket 20 to the sidewall 38 of the container 26. It is envisioned that the support 30 need not be formed in one piece with the container 26 but may be secured on the inner surface of the sidewall 38 of the container 26 with fasteners or adhesive. The container 26 may employ a single sidewall 38 or a double sidewall 38 (see FIG. 9). The use of a double sidewall 38 allows the wiring 32 to be disposed between the two walls so that it is protected from the soil and water that is inside the inner wall of the container 26. It is envisioned that this embodiment will employ light globes 14 to protect the light bulbs 12 or light sources. The globes 14 may be made in the same manner and have all the characteristics of the light globes 14 of the previous embodiment. The container 26 may be provided with reflective material 46 or reflective elements adjacent the light globes 14 to reflect and focus the light as needed. It is also envisioned that the light globes 14 of either embodiment may incorporate reflective material 46 located over a portion thereof. The reflective material 46 would preferably be located or disposed on the inner surface of the globe 14 but may be located on the outer surface in lieu or in addition to the inner surface. Having reflective material 46 on the light globes 14 eliminates the need for reflective material 46 on the container 26 or the light shields 16.

Figure 10:
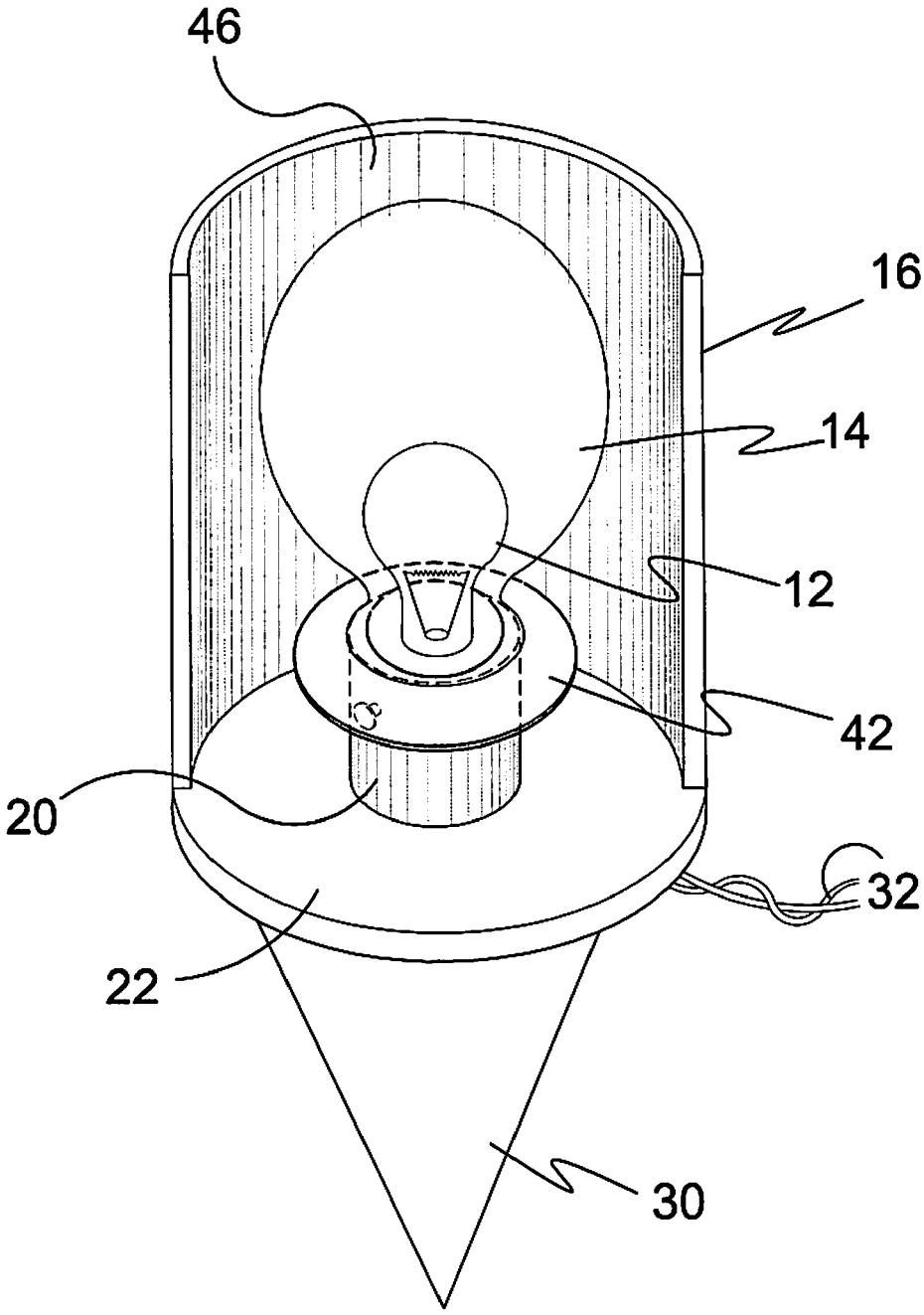
FIG. 10 is a front perspective view of a light unit of the present invention with an additional element.

FIG. 10, is a front perspective view of a light unit of the present invention 10 with an additional element. Shown is a splashguard 42 of the present invention 10. The splashguard 42 may be employed with either embodiment of the present invention 10, i.e. where the lights are separate from the container 26 or where the lights are integral with the container 26. The splashguard 42 prevents splashing water from entering into the electrical connection between the bulb 12 and the socket 20 of the light fixture. The splashguard 42 may be an independent member installed between the bulb 12 and socket 20, it may be molded into the socket 20, it may be molded into the light globe 14, or it may be a separate piece secured on or around the light globe 14.

I claim:

1. An illumination apparatus for use with a plant container comprising:

said plant container containing potting soil and a plant rooted in said potting soil, a plurality of illumination fixtures within said plant container mounted in a top surface of said potting soil spaced around said plant, said fixtures being interconnected by wiring and not extending above a top rim of said plant container;

each said illumination fixture having a base for supporting an illumination source mounted in a socket, each said illumination fixture having a light shield directing light toward said plant, each said illumination fixture having an anchor extending down from said base and buried in said potting soil for securing the illumination source in the plant container, said base being on said top surface of said potting soil, and a transformer providing power to the illumination apparatus.

2. The illumination apparatus of claim 1, wherein each said illumination fixture has a light globe removably secured thereon.

3. The illumination apparatus of claim 2, wherein the each globe has a drip contour to allow water to drain from the globe without entering said socket, said drip contour comprising a second enlarged section below a first enlarged section of said globe, said second enlarged section being directly adjacent said socket.

4. The illumination apparatus of claim 3, wherein each globe has a splash guard mounted between said socket and said globe.

5. The illumination apparatus of claim 1 having a switch which includes an ambient light sensor for turning on and off the illumination sources based on the amount of ambient light at said sensor.

6. The illumination apparatus of claim 2, wherein each globe is made of a durable plastic material.

7. The illumination apparatus of claim 6, wherein the plastic of at least one globe is transparent.

8. The illumination apparatus of claim 6, wherein the plastic of at least one globe is translucent.

9. The illumination apparatus of claim 6, wherein the plastic of at least one globe is colored plastic.

10. The illumination apparatus of claim 9, wherein the plastic of the at least one globe is translucent.

11. An illumination apparatus for use with and in combination with a plant container comprising:

said plant container having an outer wall and containing potting soil and a plant rooted in said potting soil, a plurality of illumination fixtures within said plant container having means for mounting said fixtures on an inside surface of said outer wall of said plant container, said fixtures spaced above a top surface of said potting soil and spaced apart around said plant, and said fixtures not extending above a top rim of said outer wall, each said mounting means comprising an L-shaped am extending out from said inside surface of said outer wall with said lighting fixture having a socket located on a top edge of said arm, a light source in each said socket, a light globe enclosing each light source, each said light globe having a drip contour to allow water to drain from the globe without entering said socket, said dip contour comprising a second enlarged section below a first enlarged section of said globe, said second enlarged section of said globe being directly adjacent said socket, and a transformer providing power to the illumination apparatus through wiring extending through said outer wall of said container and through said L-shaped arms.

* * * * *